US006974104B2

(12) United States Patent
Müller et al.

(10) Patent No.: US 6,974,104 B2
(45) Date of Patent: Dec. 13, 2005

(54) METHOD FOR WINDING ONTO A TOROIDAL CORE

(75) Inventors: Lothar Müller, Heidelberg (DE); Karsten Frey, Giengen (DE)

(73) Assignee: Epcos AG, Munich (DE)

( * ) Notice: Subject to any disclaimer, the term of this patent is extended or adjusted under 35 U.S.C. 154(b) by 24 days.

(21) Appl. No.: 10/467,131

(22) PCT Filed: Jan. 22, 2002

(86) PCT No.: PCT/DE02/00192

§ 371 (c)(1),
(2), (4) Date: Jan. 15, 2004

(87) PCT Pub. No.: WO02/061773

PCT Pub. Date: Aug. 8, 2002

(65) Prior Publication Data

US 2004/0108401 A1 Jun. 10, 2004

(30) Foreign Application Priority Data

Feb. 2, 2001 (DE) ..... 101 04 717

(51) Int. Cl.[7] ..... H01F 41/08
(52) U.S. Cl. ..... 242/434; 242/434.7
(58) Field of Search ..... 242/434, 434.5, 242/434.7, 443

(56) References Cited

U.S. PATENT DOCUMENTS

| | | | | |
|---|---|---|---|---|
| 2,245,180 | A * | 6/1941 | Boyajian | 242/434.7 |
| 4,768,725 | A * | 9/1988 | Daines et al. | 242/434.5 |
| 6,520,445 | B2 * | 2/2003 | Araujo | 242/434.5 |
| 2001/0030256 | A1 * | 10/2001 | Araujo | 242/434.5 |
| 2003/0102399 | A1 * | 6/2003 | Veress | 242/434.7 |

FOREIGN PATENT DOCUMENTS

| | | |
|---|---|---|
| DE | 1 201 488 | 9/1965 |
| DE | 38 28 629 | 3/1990 |
| DE | 197 08 227 | 9/1998 |
| JP | 01091409 | 4/1989 |
| JP | 04017314 | 1/1992 |

* cited by examiner

*Primary Examiner*—Emmanuel M Marcelo
(74) *Attorney, Agent, or Firm*—Fish & Richardson P.C.

(57) ABSTRACT

A method is used to wind a toroidal core with a wire obtained from a magazine having a ring shape. The method includes winding the wire onto the toroidal core in a fixed winding plane, rotating the toroidal core during winding, the rotating being about an axis that is perpendicular to a plane of the ring shape of the magazine, and holding the toroidal core using a gripper that moves with the toroidal core during winding.

14 Claims, 2 Drawing Sheets

METHOD FOR WINDING ONTO A TOROIDAL CORE

FIELD OF THE INVENTION

The invention relates to a method of winding a toroidal core, where the toroidal core is rotated around an axis that is perpendicular to the plane of the ring.

BACKGROUND

Methods of the type named at the beginning are known, in which the toroidal core is wrapped in a fixed plane, using a wire magazine. The toroidal core is held between three rollers offset at an angle of 120°, and is moved to the appropriate winding position by uniform turning of the rollers.

This method has the disadvantage that the change in size of the toroidal core that ensues after the winding process begins, due to the applied windings, leads to an eccentric position of the core with respect to the wire magazine. The thicker the wound wire, the greater the resulting eccentricity. For this reason, the hole in the center of the toroidal core must be significantly larger than the cross-section of the wire magazine utilized. Consequently, the known method of winding toroidal cores, with a resulting remaining hole having the size of the utilized magazine cross-section, is not suitable.

Furthermore, the known method with the roller drive results in wobbling of the toroidal core during the winding process, which also requires the hole in the center of the toroidal core to be larger.

SUMMARY

The objective of the present invention is therefore to specify a method of winding a toroidal core that makes it possible to wind small toroidal cores.

This objective is achieved according to the invention through a method of winding a toroidal core according to claim 1. Preferred embodiments of the invention may be found in the other claims.

The invention specifies a method of winding a toroidal core with a wire, where the winding of the toroidal core occurs in a fixed winding plane. During the winding process, the toroidal core is held by a gripper traveling together with the toroidal core, and is rotated about its axis, which is perpendicular to the plane of the ring.

The method according to the invention has the advantage that the toroidal core is always held firmly by the gripper, independent of the wire wound onto it, and that eccentricities can thereby be avoided. The winding of the toroidal core can be carried out, for example, using a wire magazine that is also essentially in the form of a ring. During the process, the gripper can conduct the toroidal core around the magazine in the clockwise or counterclockwise direction.

The area on the toroidal core used by the gripper can be kept small, and in an advantageous further development of the invention is only large enough to correspond to the distance between two windings necessary for insulation, so that no restriction in the winding of the toroidal core results from the area taken up by the gripper.

In another advantageous embodiment of the invention, the gripper covers less than 4% of the circumference of the toroidal core. This makes it possible to ensure that there is no restriction on winding the toroidal core with windings, since a minimum distance must be maintained between the individual windings anyway for reasons of electrical insulation. If necessary, the gripper can be adjusted to the minimum distance between two windings, so that any restriction of the windings by the gripper is precluded.

It is also advantageous while winding the toroidal core to have a thrust bearing positioned in the vicinity of the winding plane, through which the ring can slide, and which absorbs the tensile forces of the wire that arise during the winding process. The thrust bearing is especially necessary for gripper positions where the plane in which the gripper lies is perpendicular to the winding plane. The moments acting on the gripper, produced by the tensile forces of the wire, are greatest in that case.

In order to be able to wind the entire circumference of the core, it is advantageous for the thrust bearing to remain engaged with the toroidal core only until the gripper necessarily approaches the thrust bearing toward the end of the winding process. At that time the thrust bearing can swivel out, and the gripper can produce even further rotary motion of the toroidal core. That allows the core to be wound almost completely. In this gripper position, the bending moments produced by the tensile forces that act on the gripper are also no longer critical, since the gripper plane is then at only a very small angle to the winding plane.

The method of winding a toroidal core can be further improved by controlling the gripper by a precise stepper motor. That makes possible an exact specification of the gradient, that is, the necessary advance of the toroidal core in relation to the wire diameter, even for multi-layer chokes.

The method according to the invention has the further advantage that even extremely small toroidal cores having an outside diameter <4 mm, which cannot be wound using the roller bearings, are now accessible to winding with automatic winding machines.

In addition, it makes possible the winding of toroidal cores having a relatively small center hole, where the winding can be done with thick wires or a high number of windings.

With a very small or narrow gripper, the core can be wound over an angle of at least 350°.

The invention is explained below on the basis of an exemplary embodiment and the associated figures.

DETAILED DESCRIPTION

Figure 1:
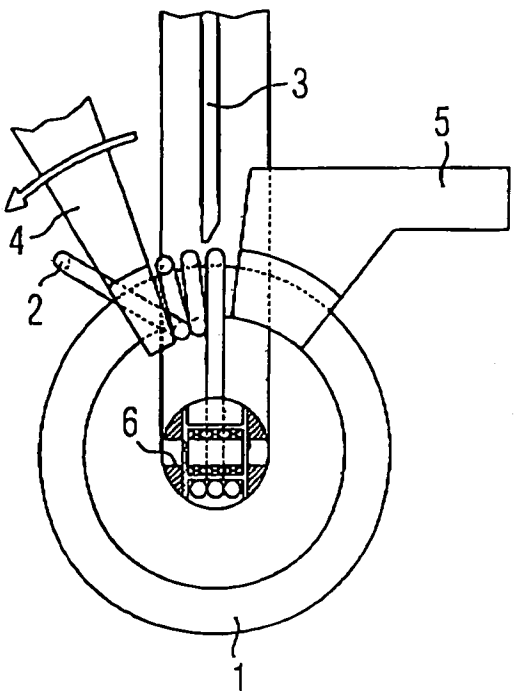
FIG. 1 shows a schematic representation of an example of a device for carrying out the method according to the invention, at the beginning of the winding process.

FIG. 1 shows a toroidal core 1 in the form of a circular ring, whose top and bottom sides are each bounded by a flat surface. Toroidal ring 1 is wound in the fixed winding plane 3 using a wire magazine 6, which is shown in cross-section in FIG. 1, and which extends perpendicular to the plane of the drawing. The wire 2 wound on the wire magazine 6 is being wound onto toroidal core 1. Toroidal core 1 is moved by a gripper 4 that holds the toroidal core. The curved arrow indicates the direction of rotation of gripper 4. Located on the side of wire magazine 6, opposite gripper 4, is a thrust bearing 5, which absorbs the bending moments that result from the tensile forces of the wire.

Figure 2:
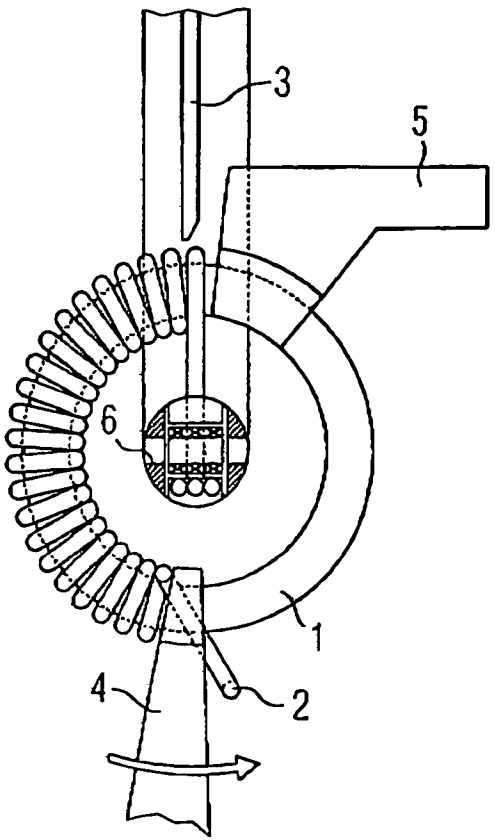
FIG. 2 shows a device according to FIG. 1, approximately halfway through the winding process.

FIG. 2 shows the device according to FIG. 1, with about half of the winding process completed.

Figure 3:
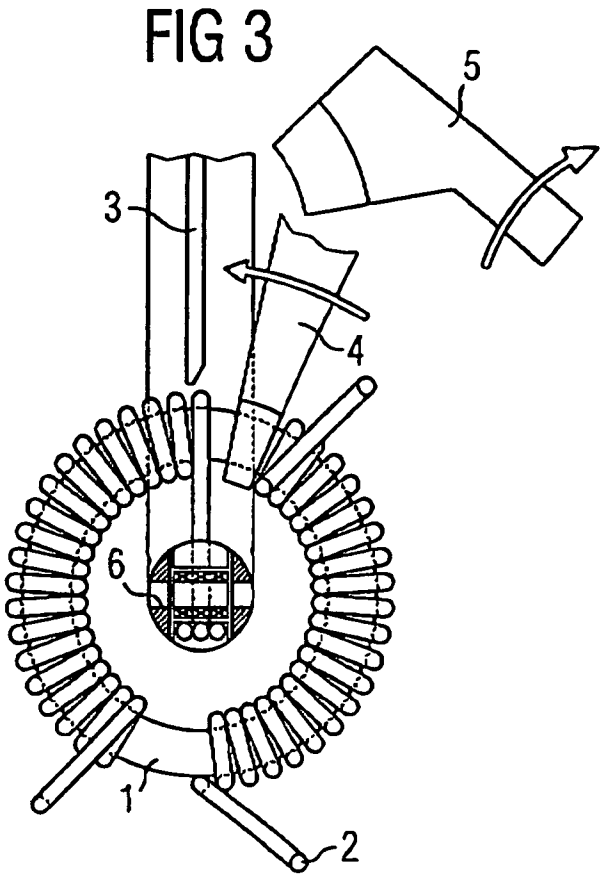
FIG. 3 shows a device according to FIG. 1, toward the end of the winding process.

FIG. 3 shows the device according to FIG. 1, shortly before completion of the winding process. In order to be able to wind the largest possible portion of toroidal core 1, toward the end of the winding process thrust bearing 5 is disengaged by a movement indicated by the arrow, so that gripper 4 can continue to move the core 1 in the direction of winding and can approach close to the winding plane 3. At the same time, it assumes the supporting function of thrust bearing 5. In this state, there are also no large bending moments, since the plane of gripper 4 is only at a very small angle to the winding plane 3.

Figure 4:
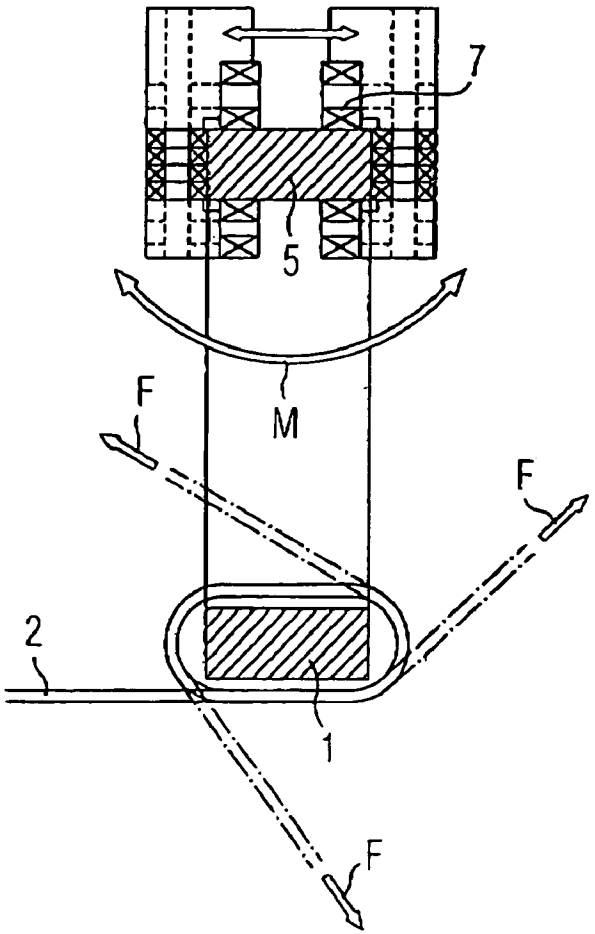
FIG. 4 shows a sectional view through a device according to FIG. 1, showing the thrust bearing.

FIG. 4 shows toroidal core 1 held by thrust bearing 5. Also shown are various positions of the wound-on wire 2. The tensile forces F are always exerted here in the direction of the wire. They produce a bending moment M, which is illustrated by the curved double arrow.

Toroidal core 1 can be supported in thrust bearing 5 in this case by means of a ball bearing 7. However, it is also possible to support toroidal core 1 in thrust bearing 5 by means of a plastic that allows slip.

Figure 5:
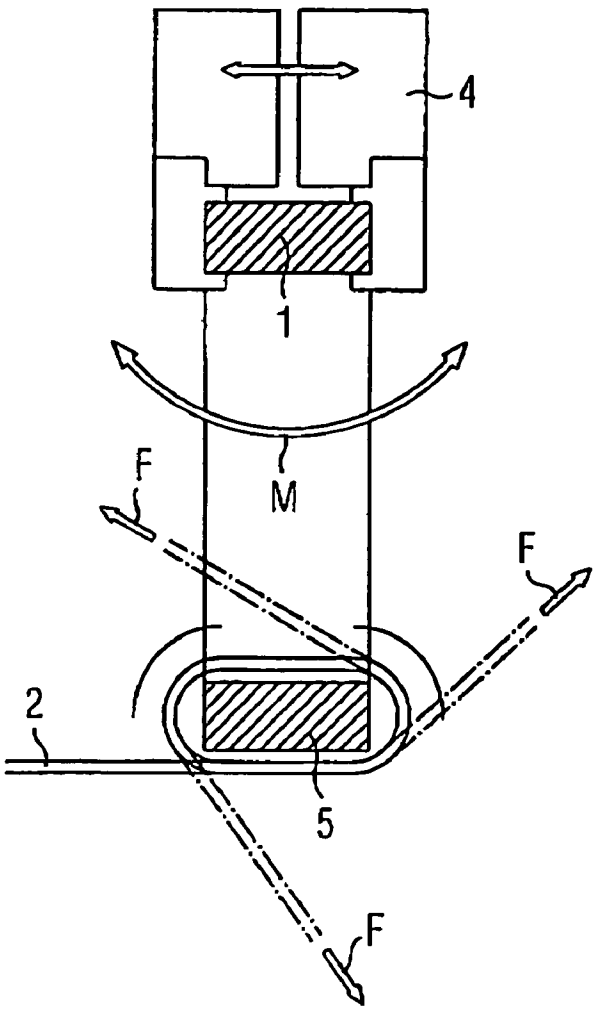
FIG. 5 shows a sectional view through a device according to FIG. 1, showing the gripper.

FIG. 5 shows the toroidal core 1 firmly held by gripper 4, with the plane of the section lying in the winding plane. In addition, wire 2 is shown schematically at various instants during the winding process. The representation of the tensile forces F and of the bending moment M corresponds to the representation in FIG. 4. Gripper 4 can consist of two halves, which can be removed from toroidal core 1 by pushing them apart in the direction indicated by the double arrow, enabling toroidal core 1 to be removed after the winding process.

The invention is not limited to the illustrated exemplary embodiments, but is defined in its most general form by claim 1.

What is claimed is:

1. A method of winding a toroidal core with a wire, the method comprising:

winding the wire onto the toroidal core in a fixed winding plane;

rotating the toroidal core during winding, the rotating being about an axis that is perpendicular to a plane of the toroidal core; and holding the toroidal core using a gripper that moves with the toroidal core during winding.

2. The method of claim 1, further comprising:

absorbing tensile forces that arise during winding using a thrust bearing that is positioned in a vicinity of the winding plane, the toroidal core being slidable through the thrust bearing.

3. The method of claim 2, further comprising:

removing the thrust bearing toward an end of winding in order to allow the gripper to move to a position previously occupied by the thrust bearing.

4. The method of claim 2, wherein the gripper covers less than 4% of a circumference of the toroidal core.

5. The method of claim 1, wherein the gripper covers less than 4% of a circumference of the toroidal core.

6. The method of claim 5, further comprising:

removing the thrust bearing toward an end of winding in order to allow the gripper to move to a position previously occupied by the thrust bearing.

7. An apparatus for winding a toroidal core with a wire, the apparatus comprising:

means for winding the wire onto the toroidal core in a fixed winding plane;

means for rotating the toroidal core during winding about an axis that is perpendicular to a plane of the toroidal core; and means for holding the toroidal core, the means for holding moving with the toroidal core during winding.

8. The apparatus of claim 7, further comprising:

means for absorbing tensile forces that arise during winding.

9. The apparatus of claim 8, further comprising:

means for removing the means for absorbing toward an end of winding in order to allow the means for holding to move to a position previously occupied by the means for absorbing.

10. The apparatus of claim 7, wherein the means for holding covers less than 4% of a circumference of the toroidal core.

11. An apparatus for winding a toroidal core, the apparatus comprising:

a magazine to provide wire to be wound around the toroidal core in a fixed winding plane, the toroidal core being rotatable about an axis that is perpendicular to a plane of the toroidal core; and a gripper to hold the toroidal core during rotation, the gripper moving with the toroidal core during winding.

12. The apparatus of claim 11, further comprising;

a thrust bearing that is positioned in a vicinity of the winding plane to absorb tensile forces that arise during winding, the toroidal core being slidable through the thrust bearing.

13. The apparatus of claim 12, wherein the gripper covers less than 4% of a circumference of the toroidal core.

14. The apparatus of claim 11, wherein the gripper covers less than 4% of a circumference of the toroidal core.

* * * * *